United States Patent [19]

Purcell et al.

[11] Patent Number: 4,964,397

[45] Date of Patent: Oct. 23, 1990

[54] FIREPLACE CONSTRUCTION

[76] Inventors: David S. Purcell, 971 N. Clay, Kirkwood, Mo. 63122; Kelley J. Wells, 6424 Stillhouse La., Highridge, Mo. 63049

[21] Appl. No.: 408,116

[22] Filed: Sep. 15, 1989

[51] Int. Cl.[5] ..... F24B 1/195

[52] U.S. Cl. ..... 126/552; 126/522; 126/523; 126/527; 126/531

[58] Field of Search ..... 126/552, 553, 500, 522, 126/523, 528, 531, 550, 524, 529, 83

[56] References Cited

U.S. PATENT DOCUMENTS

| | | | |
|---|---|---|---|
| 1,314,968 | 9/1919 | Maritzen | 126/523 |
| 1,656,326 | 1/1928 | Johnson | 126/523 |
| 1,681,670 | 8/1928 | Marks | 126/531 |
| 1,766,601 | 6/1930 | Cesa | 126/523 |
| 2,396,535 | 3/1946 | Rumery | 126/531 |
| 2,439,503 | 4/1948 | Austin | 126/531 |
| 2,825,326 | 3/1958 | Flynn, Jr. | 126/553 |
| 2,829,634 | 4/1958 | Wyatt | 126/523 X |
| 4,574,774 | 3/1986 | Wells | 126/527 |

*Primary Examiner*—Larry Jones
*Attorney, Agent, or Firm*—Haverstock, Garrett & Roberts

[57] ABSTRACT

In a fireplace unit having an open sided firebox formed by opposed side walls, a top wall, a bottom wall, a rear wall, and a connection in the top wall to an exhaust flue, the present improvement including an intermediate wall member of overall curved configuration mounted in the firebox opening, the intermediate wall member being spaced from the rear wall of the firebox and extending between the opposed side walls and, at least, the bottom wall thereof to define a substantially enclosed space in the firebox opening therebehind, the curved configuration of the intermediate wall member increasing the reflective and radiant characteristics of the interior of the firebox thereby improving its overall efficiency and heat transfer capabilities. The various embodiments of the intermediate wall member disclosed herein may be attached to the firebox by fasteners, by welding, or by other suitable arrangements, or such intermediate wall member may be integrally formed as part of the firebox itself.

27 Claims, 4 Drawing Sheets

FIREPLACE CONSTRUCTION

PRIOR ART

The closest known prior art to the present invention is Wells U.S. Pat. No. 4,574,774 dated Mar. 11, 1986, entitled Fireplace Accessory. This patent discloses a fireplace accessory for mounting within a fireplace opening as a stand alone unit with the possibility for air circulation on all sides of the unit including around the top, bottom, ends and sides. The present constructions, by contrast, provide intermediate wall means for isolating or substantially isolating from each other the spaces in the firebox on opposite sides of the intermediate wall means. This is done in the present constructions by providing a wall member for installing in a fireplace opening or firebox in a position extending between the side walls, the bottom wall, and, in some embodiments, the top wall of the firebox. Furthermore, in the present constructions, the grate is positioned on the floor of the firebox in front of the intermediate wall means, while in the prior art construction the wall member extends upwardly from the grate. The present constructions therefor contain features which are structurally and operationally substantially different from the patented construction and, as such, achieve different results.

BACKGROUND AND SUMMARY OF THE INVENTION

The present invention relates to improvements to a fireplace construction such as the type that is often installed in a masonry or zero clearance fireplace opening. The invention modifies the existing firebox construction by providing an intermediate wall which is spaced forward of the rear wall of the firebox and extends between and, in some embodiments, completely closes a space between the side walls, the top wall and bottom wall or floor of the firebox. The fireplace unit itself, sometimes referred to as a firebox insert, has an opening on one side formed by spaced side walls, a rear wall, and top and bottom walls with connection means in the top wall for communicating the firebox with a chimney or other exhaust outlet. The present invention resides in the construction and installation of the intermediate wall member.

The intermediate wall member is preferably of a curved or arcuate shape or a wall formed of angularly related segments. In some embodiments, the bottom edge of the intermediate wall member extends closer to the rear wall of the firebox opening at or near the bottom or floor thereof as compared to the top edge which extends closer to the front portion of the firebox near the top thereof. This means that, in this particular arrangement, the upper portion of the intermediate wall member overhangs the area in the firebox where the fire takes place. In other embodiments of the present invention, this is not necessarily true as will be hereinafter further explained.

Of great importance to the present invention is the fact that the overall size and shape of the fireplace insert need not generally be changed from a conventional construction to accomodate the present intermediate wall member. This means that the fireplace can be made to fit a conventional masonary or other wall opening. The intermediate wall member preferably should fit snuggly into the firebox opening and may be attached to the other walls and deck of the firebox by fasteners, by welding, or by other suitable means. Installation can be made to existing fireplaces or the intermediate wall member can be installed or otherwise fabricated in the fireplace by the manufacturer. Use of the intermediate wall member increases the reflective and radiant characteristics of the interior of the firebox and it prevents flames and embers from entering the space behind the intermediate wall member.

The present intermediate wall member preferably extends to the bottom wall or floor of the firebox to maximize the size of its reflective or radiant surface, and, in most cases, it will also reduce the overall size of the floor of the fireplace thereby making the fireplace somewhat easier to clean. In the embodiments of the present invention where the intermediate wall member actually abuts the top wall of the firebox, it is preferred that such intermediate wall abut the top portion of the firebox along as much of its length as possible to both provide additional stability and rigidity to the intermediate wall and to again maximize its effectiveness over the area where combustion takes place thereby also increasing the efficiency of the fireplace. The construction and positioning of the intermediate wall will also help prevent downdrafts from reaching the firebox where they can blow out a pilot light or cause other problems such as blowing fire and ashes into the room. This can be a problem especially when a gas source is used as when the fireplace is used with a gas or artificial fire. Similarly, in those embodiments of the present invention where the intermediate wall member abuts or at least extends forward of the exhaust flue or chimney opening in the firebox, the top edge portion of the intermediate wall member should have at least a portion thereof which is not attached to the top wall of the firebox or does not block or otherwise interfere with the flue or chimney opening so as to provide communication between the firebox and the exhaust flue so that the products of combustion can escape.

The intermediate wall member may be made from a single thickness sheet metal member or it may be constructed of spaced connected wall panels with a space formed therebetween, which space may be left empty for air to circulate therethrough, or it may be filled with an insulating material. If an airspace is provided in the present wall member, then suitable holes or passageways should be provided to permit the air to circulate therebetween. The important thing is that the intermediate wall member extend between the side walls and, in some embodiments, between the floor and the top wall of the firebox as well, and that it be spaced forward of the rear wall so as to form an airspace therebetween.

In some embodiments of the present invention the upper overhanging portion of the intermediate wall member can be constructed to have an irregular, contoured shape such as an egg-carton like shape or other grid type construction so as to form overhead air pockets or air traps for the air that has been heated. This is done to increase the surface area for heat transfer and to retard the movement of hot gases as they move upwardly in the firebox before they enter the exhaust flue or chimney. Retarding or slowing the movement of these hot gases keeps such gases in contact with the intermediate wall over a relatively large surface area thereby increasing the heat transferred to the wall and further increasing the efficiency of the firebox. Such an irregular or pocketed shape for the upper portion of the intermediate wall member also operates to further oxidize the escaping gases. It is not generally desired, however, to extend the irregularly shaped portion of the intermediate wall downwardly too far into the firebox because to do so will only provide more places for the ashes and other products of combustion to be trapped making the firebox harder to clean and maintain.

The present intermediate wall means also has application to other devices such as to top-feed wood pellet stoves and other devices where fires are burned in open sided fireboxes.

It is therefore a principal object of the present invention to provide wall means for installing in fireplaces and in certain stoves and in other heating devices to increase their operating efficiency.

Another object is to provide means for modifying an existing fireplace construction such as a conventional fireplace construction of the type installed in masonary openings and the like, to improve its operating characteristics and efficiency.

Another object is to make it relatively easy to clean the combustion chamber of a fireplace or like device.

Another object is to improve the heat reflecting and insulating characteristics of fireplaces.

Another object is to provide a wall structure for installing in fireplace openings and the like which can be made adjustable to fit different size and width firebox openings, which wall structure substantially isolates the spaces on opposite sides thereof.

Another object is to teach the construction and installation of a relatively simple and inexpensive wall for installing in the firebox portion of a fireplace assembly.

Another object is to provide a wall structure for installing in fireboxes and the like which has good insulating characteristics.

These and other objects and advantages of the present invention will become apparent after considering the following detailed specification which discloses several different embodiments of the present invention in conjunction with the accompanying drawings.

DETAILED DESCRIPTION OF PREFERRED EMBODIMENTS

Figure 1:
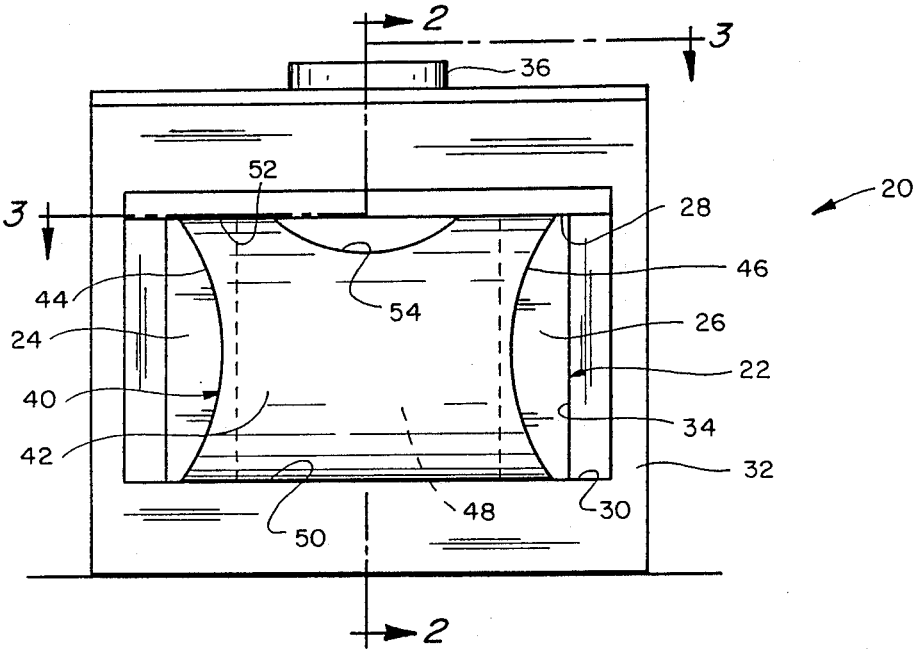
FIG. 1 is a front elevational view of a fireplace assembly incorporating the teachings of the present invention.

Referring to the drawings more particularly by reference numbers wherein like numerals refer to like parts, number 20 in FIG. 1 identifies a fireplace structure for installing in a suitable fireplace opening such as in a masonary or other installation location. The fireplace 20 is shown of rectangular shape having an open sided firebox 22 formed by and between spaced side walls 24 and 26, an upper roof wall portion 28, and a lower wall or floor 30. The side walls 24 and 26 are shown as being angularly related to each other, the side walls 24 and 26 becoming closer together at the rear portion of the firebox 22. The fireplace 20 also has an optional front or trim face 32 with a rectangular opening 34 into the firebox 22. The upper wall portion 28 of the firebox 22 may have a suitable curtain or curtain-type wall or shield which communicates with an outlet fitting 36 which in turn communicates with a chimney or other flue outlet (not shown).

Figure 2:
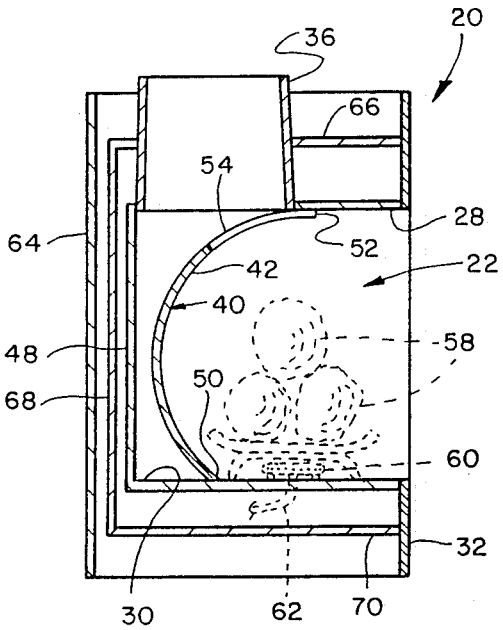
FIG. 2 is a cross-sectional view taken along line 2—2 of FIG. 1 and showing a grate with logs thereon in dotted outline form.

Of particular importance to the present construction is the addition of an intermediate wall member 40 which is installed or otherwise formed in the firebox 22. In the embodiment illustrated in FIGS. 1–3, the intermediate wall 40 is shown as a curved wall 42 having opposite side edges 44 and 46 which are shaped to abut the respective side walls 24 and 26 of the firebox 22 to prevent communication around the side edges of the wall member 40 between the spaces on opposite sides thereof including the space behind the wall member 40 and in front of the rear firebox wall 48. The wall member 40 also extends from a lower edge 50 which abuts the floor 30 of the firebox 22 relatively near the rear portion thereof to its upper edge 52 which abuts or closely approaches the top wall or roof portion 28 of the firebox at a location forward of where the lower edge 50 abuts the floor 30 (FIG. 2). The center portion of the upper edge 52 has a cutout shown as a rounded or other shaped cutout 54 centrally located and provided to establish communication between the open side of the firebox 22 in front of the wall 40 and the outlet fitting 36 which communicates with the chimney or flue outlet. The intermediate wall 40 can be welded or otherwise attached to the abuting surfaces of the walls 24, 26, 28 and 30 such as by fasteners or other means so as to make it secure and to reduce the possibility for communication between the spaces on opposite sides thereof for reasons which will become apparent hereinafter, or, in certain prefabricated, stand alone zero clearance fireplaces, the wall member 40 can be integrally formed with the firebox.

Referring to FIG. 2, the wall 40 is clearly shown mounted with its lower edge 50 abutting or otherwise attached or formed to the floor 30 of the firebox 22 at a location rearward to where the upper edge 52 of the wall 40 abuts or comes in close proximity to the roof portion 28. This is done for several reasons including to provide sufficient room to enable placement of a grate 56 for logs 58 in front of the wall 40, as shown in dotted outline form in FIG. 2. Such placement of the wall 40 also provides a portion thereof that overhangs the grate 56. The provision for an optional gas burner and/or pilot light 60 connected by a gas line 62 to a suitable source of fuel is also illustrated in FIG. 2. The gas line 62 for the pilot light or burner 60 can be used to start a fire or to maintain an artificial fire. For most installments, however, it is expected that real logs will be positioned on the grate 56 for burning. In such event, a gas line may still be provided for connection to a pilot light in a well known manner.

The opening or cutout 54 formed in the upper edge 52 of the wall 40 establishes communication between the space in front of the wall 40 in the firebox 22 and the outlet fitting 36 as aforesaid. This space may be dampered by suitable damper means (not shown) and provides means for the products of combustion burned in the firebox 22 to escape into the atmosphere. If desired, the fireplace assembly 20 can also be provided with other optional walls such as the walls 64, 66, 68 and 70 as shown. Use of these additional walls or other wall arrangements will depend to some extent on the manufacturer of the fireplace.

Figure 6:
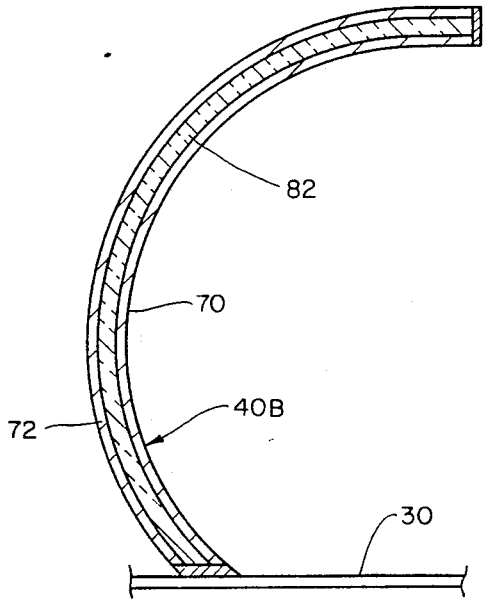
FIG. 6 is a cross-sectional view similar to FIG. 5 showing another embodiment of the present intermediate wall member.
Figure 5:
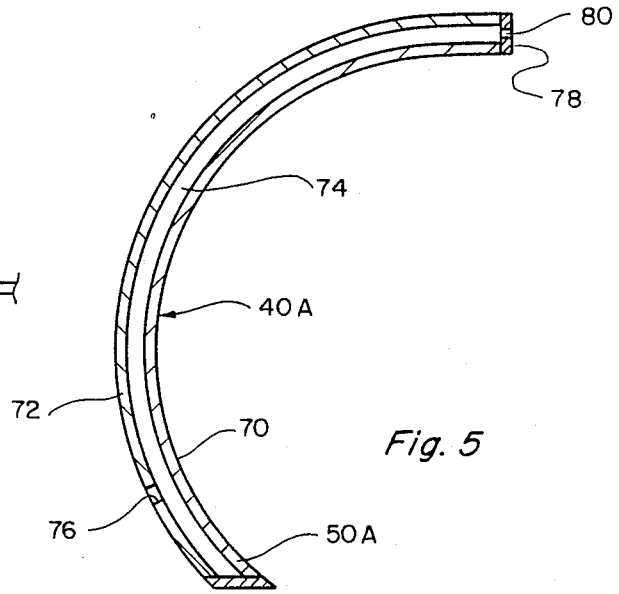
FIG. 5 is a cross-sectional view taken along line 5—5 of FIG. 4.
Figure 4:
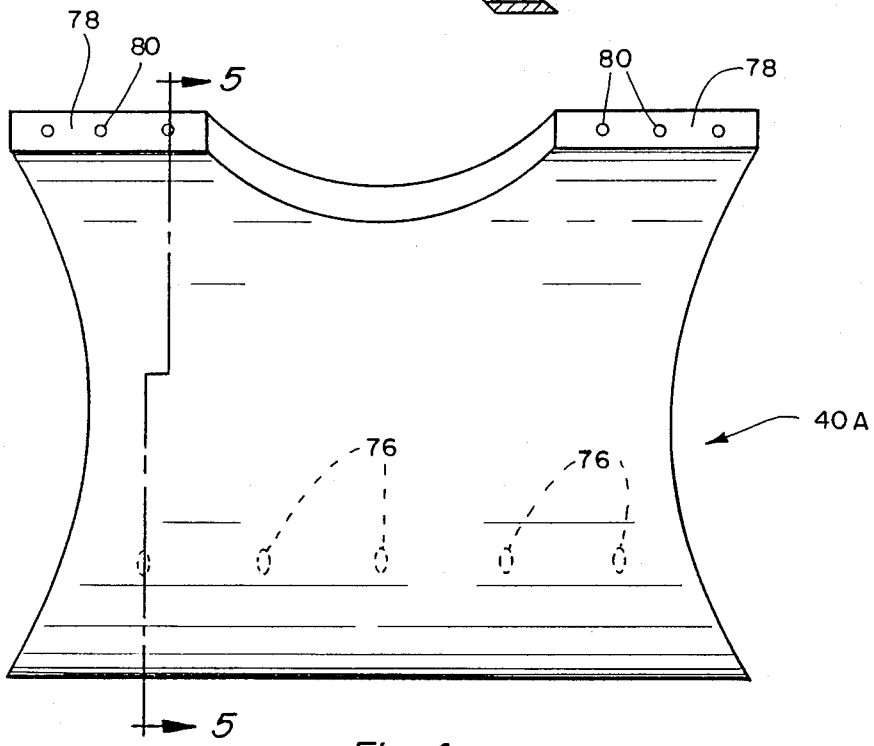
FIG. 4 is a front elevational view showing a wall member per se for installing in a fireplace.

The construction of the intermediate wall 40 can vary depending upon requirements and several different embodiments of the wall 40 are shown in the accompanying drawings. For example, FIGS. 4 and 5 show a double walled construction for the wall member 40A wherein the member 40A includes a front wall panel 70 and a rear wall panel 72 of similar shape, the rear panel 72 being spaced behind the panel 70 with air space 74 therebetween closed on the edges by connecting end and side edge walls. The rear panel 72 is shown having openings 76 located near the bottom edge portion 50A, and the sides and ends of the wall member 40A are closed by suitable closer walls similar to wall 78. The edge wall 78 that closes the top of the wall 40A is shown having a plurality of openings or orifices 80 extending therethrough. When the wall 40A is installed as described, some of the air near the bottom of the rear side of the wall will enter the openings 76 and pass upwardly through the air space 74 between the wall members 70 and 72 and exit out through the openings or orifices 80. This circulating air will provide some convective characteristics and in some cases will improve the operation of the fireplace. It is also anticipated that the wall member 40B may be constructed as shown in FIG. 6 wherein the wall members 70 and 72 are separated by a layer of insulating material 82. This will further insulate the space in front of the wall 40B from the space behind the wall 40B and, in some cases, this will have advantageous effects.

Figure 7:
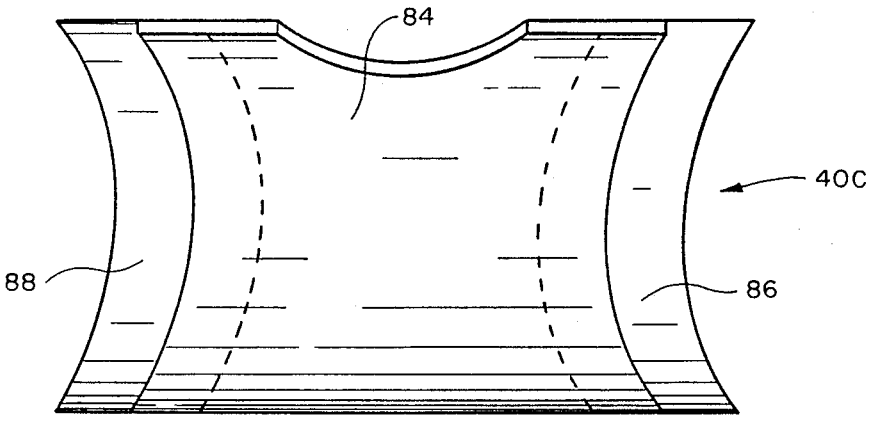
FIG. 7 is a front elevational view showing another embodiment of an intermediate wall structure for installing in a fireplace according to the teachings of the present invention.
Figure 8:
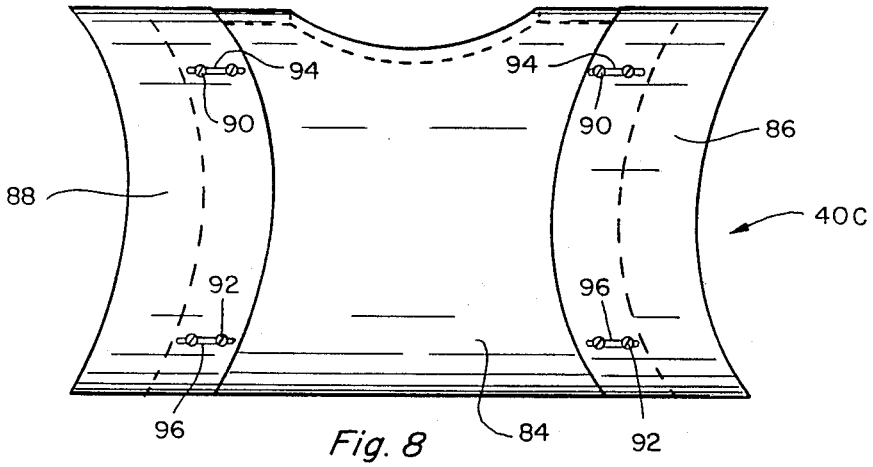
FIG. 8 is a rear elevational view of the wall structure shown in FIG. 7.
Figure 9:
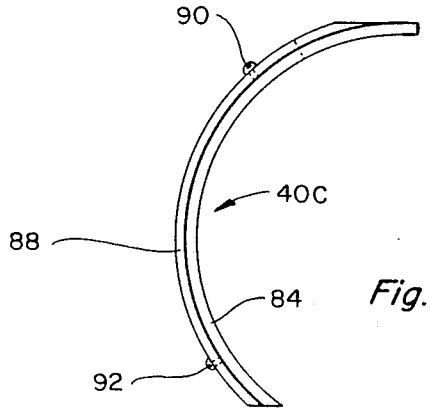
FIG. 9 is a left side elevational view of the wall structure shown in FIG. 7.

FIGS. 7, 8 and 9 illustrate another embodiment 40C of the present wall construction. The wall 40C has a shape similar to the intermediate walls described above but is adjustable lengthwise to be accommodated in different width fireboxes. This is accomplished by making the wall device with a central panel 84 which is narrower than the width of most fireboxes and attaching to such central panel 84 in the rear thereof two spaced end wall portions 86 and 88 of similar contour as best shown in FIGS. 8 and 9. The panels 86 and 88 are connected to the panel 84 by threaded or other like members 90 and 92 which extend through elongated slots 94 and 96 in the panels 86 and 88. When the threaded members 90 and 92 are loosened, the panels 86 and 88 can be moved together or apart as required to change the overall width of the structure 40C to fit the particular firebox into which it is to be installed. Except for this adjustable feature, the wall construction shown in FIGS. 7–9 is similar in all respects to the construction shown in FIGS. 1 and 2. It is recognized that the adjustability of the wall member 40C can likewise be accomplished by using any plurality of adjacent panels including using only two such panels.

Figure 10:
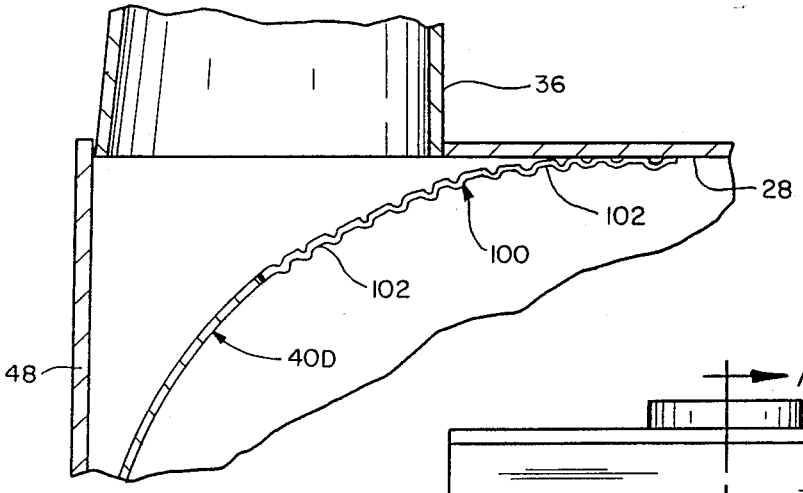
FIG. 10 is an enlarged fragmentary cross-sectional view taken through the upper portion of a fireplace showing still another embodiment of the present intermediate wall structure.

FIG. 10 shows another embodiment 40D of the present wall member 40 wherein the upper or overhanging portion 100 has an irregular contour or shape. This irregular contoured shaped portion 100 can be of a shape somewhat similar to that of an egg-carton pattern or other grid type or pocketed type construction as shown in FIG. 10. The contouring of the upper portion 100 can be formed by a suitable press. It is also contemplated alternatively to attach a contoured wall portion to the underside of the upper portion of the wall 40D as by welding or by using other suitable fastening means to achieve the same effect. The purpose of the contoured wall portion 100 is to provide spaces such as air pockets or air traps 102 and additional surface area in which the heat produced by the fire during combustion can accumulate before exiting into the chimney. This will increase the heat retaining characteristics of the wall and also increases the amount of heat that gets into the room from the fireplace. The irregular contoured shaped portion 100 of the wall 40D also helps to further oxidize the gases escaping from the fireplace which is a further advantage. It is also anticipated that fins or other such air catching and/or retarding devices may likewise be utilized to produce the same retarding or slowing of the heated air as it moves upwardly in the firebox toward the exhaust flue or chimney. It is preferred that the portion 100 be formed as an integral part of the wall 40D although it is contemplated to attach a separate irregular member as described above to the underside of the upper portion of the wall 40D to accomplish the same purpose.

Figure 11:
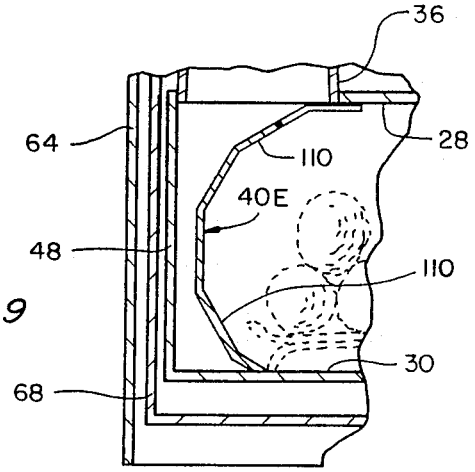
FIG. 11 shows the present wall structure constructed of angularly related segments.

FIG. 11 is a side elevational view showing still another embodiment 40E of the present intermediate wall. The wall 40E is shown formed by a plurality of angularly related wall portions 110 providing an overall side shape similar to the other constructions. The wall 40E may be somewhat easier to make than some of the other embodiments using well known forming and bending devices. The wall 40E can also be constructed having spaced panels as shown in FIGS. 4–6 and can likewise be made to have adjustable end portions as shown in FIGS. 7–9.

Figure 12:
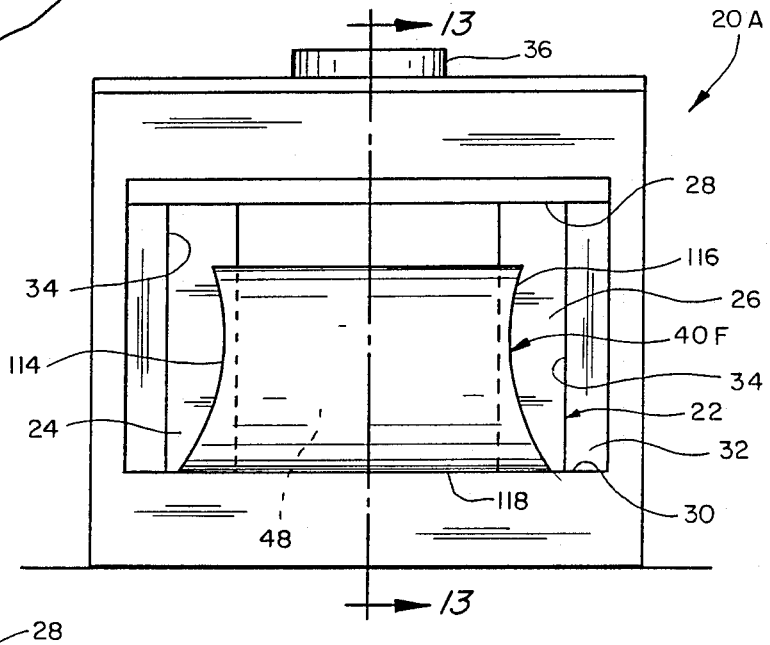
FIG. 12 is a front elevational view of a fireplace assembly showing a still further embodiment of the present invention.
Figure 13:
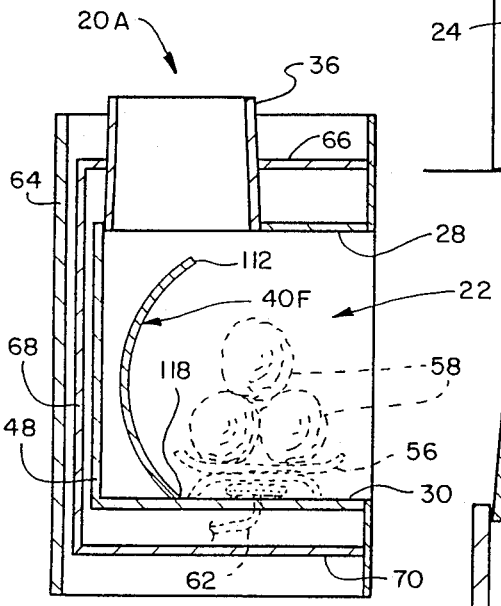
FIG. 13 is a cross-sectional view taken along line 13—13 of FIG. 12 and showing a grate with logs thereon in dotted outline form.

FIGS. 12 and 13 are substantially similar to FIGS. 1 and 2 and disclose a still further embodiment 40F of the present intermediate wall member 40 wherein the wall member 40F is constructed and dimensioned such that its upper edge portion 112 does not abut or come in close proximity to the top roof portion 28 of the firebox 22. In all other respects, the wall member 40F is substantially similar in construction to the wall member 40 illustrated in FIGS. 1–3. For example, like the intermediate wall member 40, the wall 40F is likewise shown as a curved wall having opposite side edges 114 and 116 which are similarly shaped to abut the respective side walls 24 and 26 of the firebox 22 as previously described. However, in contrast to the wall member 40 illustrated in FIGS. 1–3, the wall member 40F extends from a lower edge 118 which abuts the floor 30 of the firebox 22 to its upper edge 112 which is located at a position intermediate the top and bottom wall portions 28 and 30 respectively of the firebox 22 as shown in FIGS. 12 and 13. Since the upper edge portion 112 of the wall 40F does not come in close proximity to the upper wall portion 28 of the firebox 22, sufficient space exists between the outlet fitting 36 and the upper edge portion 112 to provide communication between the open side of the firebox 22 in front of the wall member 40F and the outlet fitting 36 which communicates with the chimney or flue outlet. This eliminates the need for the opening or cutout 54 associated with the wall member 40 illustrated in FIGS. 1–3. Like the wall member 40, the intermediate wall 40F can be welded or otherwise attached to the abutting surfaces of the firebox walls 24, 26 and 30 as previously explained, or the wall member 40F can likewise be formed integral with the firebox.

Figure 3:
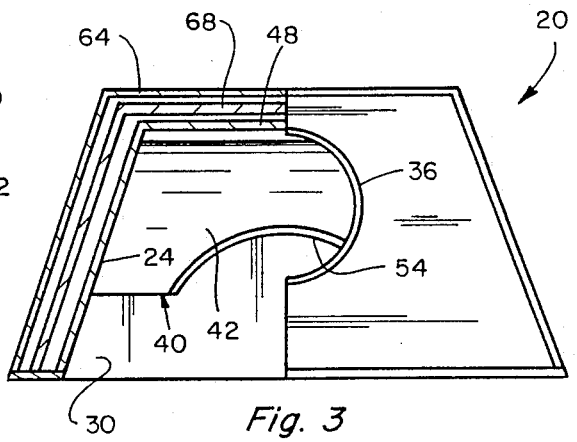
FIG. 3 is a cross-sectional view taken along line 3—3 of FIG. 1.

Referring to FIG. 13, unlike the arrangement of the wall member 40 in the fireplace 20 illustrated in FIGS. 1–3, it can be seen that the lower edge portion 118 of the wall 40F is mounted or otherwise formed integral with the floor 30 of the firebox 22 at a location substantially in line with the upper edge portion 112 located thereabove. In this particular embodiment, depending upon the particular dimensions and construction of the fireplace unit 20A, it is recognized that the upper edge portion 112 may extend either slightly forward or slightly rearward of where the lower edge 118 abuts or otherwise comes in contact with the floor 30. Any of the above-described relationships between the upper edge 112 and the lower edge 118 of the wall member 40F will produce the sought after advantages as previously described with respect to the operation of the wall member 40 (FIGS. 1–3) even through the upper wall edge 118 does not overhang the grate 56 in the same manner described and illustrated in FIGS. 1 and 2. This is true because the specific shape and design of the wall 40F provides sufficient reflective and radiant characteristics to achieve the desired results.

Figure 14:
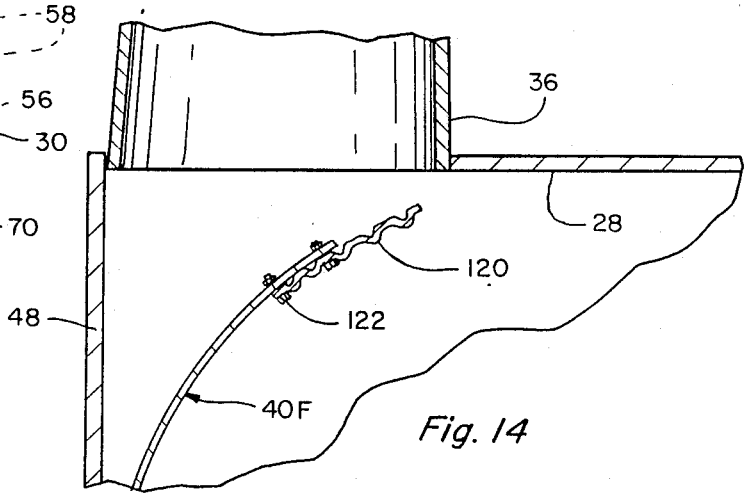
FIG. 14 is an enlarged fragmentary cross-sectional view taken through the upper portion of a fireplace showing one embodiment of a contoured shaped member which may be used in conjunction with the intermediate wall member of FIGS. 12 and 13.

The intermediate wall member 40F can likewise be made of a double walled construction having spaced panels as shown in FIGS. 4–6 and the wall member 40F can also be made to have adjustable end portions as illustrated in FIGS. 7–9. Similarly, the wall member 40F may likewise be constructed or formed from a plurality of angularly related wall portions such as the wall portions 110 illustrated in FIG. 11. Still further, the wall 40F can also be equipped with an irregularly shaped upper portion such as the portion 100 illustrated in FIG. 10. In addition, besides shaping and forming the upper portion of the wall 40F similar to the portion 100 illustrated in FIG. 10, in this particular embodiment of the present invention, the irregularly shaped pattern or other grid type construction may also be attached to the underside of the upper edge portion 112 of the wall 40F as a separate member such as the contoured shaped member 120 illustrated in FIG. 14. In this regard, the member 120 can be attached to the wall 40F by any suitable means such as by the fastening means 122. As previously explained, use of the contoured shaped portions 100 or 120 likewise enhances the overall effectiveness and operation of the wall member 40F.

Although it is anticipated that the present wall members will be constructed from metal type materials, it is also recognized that other various acceptable materials of construction may likewise be equally employed to construct the various embodiments of the present intermediate wall member including such materials as certain types of refractory tile, ceramics and other heat reflective type materials including many composite type materials.

Thus there has been shown and described several embodiments of novel improvements to a fireplace construction including providing a novel wall member for forming or mounting in a firebox so as to increase the overall efficiency of the fireplace, to realize more heat from the fireplace, and to provide a fireplace which is easier to both clean and maintain as compared to known fireplace constructions, which novel improvements fulfill all of the objects and advantages sought therefor. Many changes, modifications, variations and other uses and applications of the present constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A fireplace unit for installing in a fireplace opening including an open sided fireproof enclosure formed by connected opposed side walls, a top wall, a bottom wall, a rear wall and connection means to an exhaust flue in said top wall, the improvement comprising an intermediate wall member of overall curved configuration mounted in said fireplace opening, said intermediate wall member being located in spaced apart relationship in front of the rear wall of said fireproof enclosure and extending in abutting relationship between the opposed side walls and between the top and bottom walls of said fireproof enclosure thereby defining a substantially enclosed spaced in the fireplace opening behind said intermediate wall member, and means associated with the top wall of said enclosure and said intermediate wall member for communicating the space in front of said intermediate wall member to the exhaust flue.

2. The fireplace unit of claim 1 wherein said intermediate wall member is formed of a sheet metal material.

3. The fireplace unit of claim 1 wherein said intermediate wall member is formed of spaced members having a layer of heat insulating material positioned therebetween.

4. The fireplace unit of claim 1 wherein said intermediate wall member is formed of at least two adjacent panels, at least one of said adjacent panels being slidable endwardly relative to said other panels to change the overall width thereof.

5. The fireplace unit of claim 1 wherein said intermediate wall member includes an upper portion to be positioned adjacent to the top wall of said fireplace opening, said upper portion including an irregularly shaped portion having a plurality of spaced adjacent pocket type cavities associated therewith, said pocket type cavities being located on said irregularly shaped portion so as to at least partially overhand the combustion area of said fireproof enclosure.

6. In a fireplace unit having an open sided firebox defined by connected spaced opposed side walls, a top wall, a bottom wall, a rear wall and a fitting associated with the top wall for connection to a chimney, the improvement comprising an intermediate wall panel for mounting in the firebox opening in spaced apart relationship in front of the rear wall of said firebox, said wall panel having opposed side edges for positioning in abutment with the spaced opposed side walls of said firebox, a bottom edge for abutting the bottom wall of said firebox, a top edge for abutting the top wall of said firebox, a cutout formed in said wall panel adjacent the top edge thereof communicating the space on at least one side of said wall panel with the fitting for communicating with the chimney, and means for attaching the intermediate wall panel to at least some of the walls of said firebox.

7. The improvement of claim 6 wherein said means attaching the intermediate wall panel to at least some of the walls of said firebox include welding means.

8. The improvement of claim 6 wherein said means for attaching the intermediate wall panel to at least some of the walls of said firebox include fastener means.

9. The improvement of claim 6 wherein said intermediate wall panel is arcuate in shape.

10. The improvement of claim 9 wherein the bottom edge of said intermediate wall panel abuts the bottom wall of said firebox at a location rearward of where the upper edge of said wall panel abuts the top wall of the firebox.

11. The improvement of claim 6 wherein said intermediate wall panel is formed by a plurality of angularly related connected panel portions.

12. The improvement of claim 6 wherein the upper portion of said intermediate wall panel includes an irregularly shaped portion.

13. The improvement of claim 6 wherein said intermediate wall panel is formed of spaced parallel members having a layer of heat insulating material positioned therebetween.

14. The improvement of claim 6 wherein said intermediate wall panel is formed by adjacent connected panel portions, at least one of said panel portions being slidably movable endwardly to change the overall width thereof.

15. The improvement of claim 14 including means for locking the connected panel portions together in a fixed position.

16. In a fireplace unit having an open sided firebox formed by connected opposed side wall portions, a top wall portion, a bottom wall portion, a rear wall portion, and flue means associated with said top wall portion for connection to a chimney, the improvement comprising an intermediate wall member for mounting in the firebox opening, said intermediate wall member being arcuate in shape and including opposed side edges for positioning in abutment with the opposed side wall portions of said firebox, a bottom edge for positioning in abutment with the bottom wall portion of said firebox, a top edge located intermediate the bottom and top wall portions of said firebox, and means for attaching said intermediate wall member to at least some of the wall portions of said firebox, said intermediate wall member being positioned in spaced apart relationship in front of the rear wall portion of said firebox and behind the combustion area associated therewith so as to define a space therebetween.

17. The improvement of claim 16 wherein said intermediate wall member is formed by a plurality of angularly related panel portions.

18. The improvement of claim 16 wherein said intermediate wall member is formed of spaced parallel panel members and means for maintaining said panel members in spaced parallel relationship to one another, said intermediate wall member including a layer of heat insulating material positioned between said spaced panel members.

19. The improvement of claim 16 wherein said intermediate wall member includes adjacent connected panel portions, at least one of said panel portions being slidably movable endwardly relative to said other panel portions to adjust the overall width thereof.

20. The improvement of claim 16 wherein the upper portion of said intermediate wall member includes an irregularly shaped portion.

21. The improvement of claim 16 including an irregularly shaped member, and means for attaching said irregularly shaped member to the upper end portion of said intermediate wall member.

22. The improvement of claim 21 wherein said irregularly shaped member extends beyond the periphery of the upper end of said intermediate wall member.

23. In a fireplace unit having an open sided firebox defined by spaced opposed side walls, a bottom wall, a rear wall, and flue means associated therewith for communicating the firebox opening with a chimney, the improvement comprising an intermediate wall member for positioning within the firebox opening, said intermediate wall member including opposed side edges for positioning adjacent to the opposed side walls of said firebox, a bottom edge for positioning adjacent to the bottom wall of said firebox, a top edge which is located at a position intermediate the bottom wall and flue means associated with said firebox, said intermediate wall member extending behind the combustion area associated with said firebox and having its top and bottom edges spaced from the rear wall of said firebox, and means for locating said intermediate wall member within said firebox.

24. The improvement of claim 23 wherein said intermediate wall member is arcuate in shape.

25. A fireplace unit for installing in a fireplace opening including an open sided fireproof enclosure formed by connected opposed side walls, a top wall, a bottom wall, a rear wall and connection means to an exhaust flue in said top wall, the improvement comprising an intermediate wall member of overall curved configuration mounted in said fireplace opening, said intermediate wall member being spaced in front of the rear wall and extending between the opposed side walls and between the top and bottom walls of said fireproof enclosure thereby defining a substantially enclosed spaced in the fireplace opening therebehind, means associated with the top wall of said enclosure and said intermediate wall member for communicating the space in front of said intermediate wall member to the exhaust flue, said intermediate wall member being formed of spaced wall portions and at least one connecting end portion adjacent the top thereof, first passage means extending through one of said wall portions near the bottom thereof, and said passage means extending through said connecting end portion, said first and second passage means connecting the space between said wall portions with the space behind and in front of said intermediate wall member.

26. In a fireplace unit having an open sided firebox defined by connected spaced opposed side walls, a top wall, a bottom wall, a rear wall and a fitting associated with the top wall for connection to a chimney, the improvement comprising an intermediate wall panel for mounting in the firebox opening, said wall panel having opposed side edges for positioning in abutment with the spaced opposed side walls of said firebox, a bottom edge for abutting the bottom wall of said firebox, a top edge for abutting the top wall of said firebox, a cutout formed in said wall panel adjacent the top edge thereof communicating the space on at least one side of said wall panel with the fitting for communicating with the chimney, means for attaching the intermediate wall panel to at least some of the walls of said firebox, said intermediate wall panel being formed of spaced parallel members, means for maintaining said wall panel members in spaced parallel relationship, and first and second passage means associated with said intermediate wall panel near the bottom and top respectively thereof, said first and second passage means communicating the space between said wall panel members with the space behind and in front of said intermediate wall panel.

27. In a fireplace unit having an open sided firebox formed by connected opposed side wall portions, a top wall portion, a bottom wall portion, a rear wall portion, and flue means associated with said top wall portion for connection to a chimney, the improvement comprising an intermediate wall member for mounting in the firebox opening, said intermediate wall member being arcuate in shape and including opposed side edges for positioning in abutment with the opposed side wall portions of said firebox, a bottom edge for positioning in abutment with the bottom wall portion of said firebox, a top edge located intermediate the bottom and top wall portions of said firebox, means for attaching said intermediate wall member to at least some of the wall portions of said firebox, said intermediate wall member being positioned in front of the rear wall portion of said firebox so as to define a space therebetween and further including spaced parallel panel members and means for maintaining said panel members in spaced parallel relationship to one another, first passage means located near the bottom portion of said intermediate wall member enabling air to enter the space between said wall panel members, and second passage means located near the top of said intermediate wall member for enabling air to exit the space between said wall panel members.

* * * * *